US007621711B2

(12) United States Patent
Kauss

(10) Patent No.: US 7,621,711 B2
(45) Date of Patent: Nov. 24, 2009

(54) HYDRAULIC CONTROL SYSTEM FOR MOBILE EQUIPMENT

(75) Inventor: Wolfgang Kauss, Francheville (FR)

(73) Assignee: Bosch Rexroth AG, Stuttgart (DE)

( * ) Notice: Subject to any disclaimer, the term of this patent is extended or adjusted under 35 U.S.C. 154(b) by 198 days.

(21) Appl. No.: 10/580,410

(22) PCT Filed: Nov. 22, 2004

(86) PCT No.: PCT/DE2004/002575

§ 371 (c)(1),
(2), (4) Date: Jul. 12, 2006

(87) PCT Pub. No.: WO2005/052265

PCT Pub. Date: Jun. 9, 2005

(65) Prior Publication Data

US 2007/0107420 A1 May 17, 2007

(30) Foreign Application Priority Data

Nov. 25, 2003 (DE) ..... 103 54 956

(51) Int. Cl.
*B66F 9/06* (2006.01)

(52) U.S. Cl. ..... 414/700; 414/699; 91/171

(58) Field of Classification Search ..... 414/699, 414/700; 91/171, 515

See application file for complete search history.

(56) References Cited

U.S. PATENT DOCUMENTS

| | | | | |
|---|---|---|---|---|
| 3,032,215 | A | 5/1962 | French et al. | |
| 3,713,557 | A * | 1/1973 | Seaberg et al. | 414/700 |
| 3,872,990 | A | 3/1975 | York | |
| 4,375,344 | A * | 3/1983 | Baum et al. | 414/708 |
| 6,561,751 | B1 | 5/2003 | Ishizaki et al. | |
| 2004/0060711 | A1 | 4/2004 | Charles | |

FOREIGN PATENT DOCUMENTS

| | | |
|---|---|---|
| DE | 94 16 800 U1 | 11/1995 |
| EP | 1 362 958 A | 11/2003 |
| GB | 1 513 328 A | 6/1978 |
| WO | WO 02/081828 A | 10/2002 |

* cited by examiner

*Primary Examiner*—Donald Underwood
(74) *Attorney, Agent, or Firm*—Oliff & Berridge, PLC

(57) ABSTRACT

What is disclosed is a hydraulic control system for a mobile equipment, in particular for a wheel or backhoe loader, wherein a shovel is linked to a boom. The angular position of the shovel may be kept constant through the intermediary of an orientation control device during a pivoting movement of the boom relative to the axles of the equipment. In accordance with the invention, the orientation control device is realized such that in the event of a change of a pre-set angular position, a control signal is generated through a pilot control device, whereby a shovel control unit may be controlled in such a manner that the shovel is again returned into its predetermined angular position.

10 Claims, 2 Drawing Sheets

HYDRAULIC CONTROL SYSTEM FOR MOBILE EQUIPMENT

The invention concerns a hydraulic control system for a mobile equipment, such as a wheel loader or a backhoe loader.

In backhoe loaders or wheel loaders a boom is pivotally linked to a frame. At the end portion of the boom opposite the frame of the wheel/backhoe loader a shovel is mounted which is pivotable relative to the boom through the intermediary of a shovel cylinder. The boom is pivoted by means of a boom cylinder that is linked to the frame of the wheel/backhoe loader. The two afore-mentioned cylinders each have the form of a differential cylinder, the pressure chambers of which are connected via a pilot control device having an associated proportional valve with a variable displacement pump or a tank for extending or retracting the respective differential cylinder.

One demand to such constructions is that the relative position of the shovel should be maintained constant relative to the wheel/backhoe loader during raising or lowering of the boom, in order to avoid inadvertent dumping of the material received in the shovel. In the solution known from WO 02/081828 A1, maintaining this relative position ("self-levelling") is realized through an orientation control device wherein the pivoting movement of the shovel relative to the boom is transmitted via a thrust rod to a rotatably mounted guide member, against the control cam of which a tappet of a control valve is biased. By means of this control valve it is possible to generate a control pressure which is present in a control chamber of the proportional valve associated with the shovel cylinder. The path of the control cam is selected such that the shovel cylinder is controlled during the pivoting movement of the boom in such a way that the shovel maintains the desired position relative to the ground or to the wheel/backhoe loader. The orientation control device of the known solution is, however, realized such that only one desired relative position may be adjusted. Moreover the "self-levelling" in this known solution is possible only in one direction, i.e., in the direction of "upward pivoting" of the shovel.

"Self-levelling" may also be achieved by a particular configuration of the loading geometry of the boom and of the shovel. Thus, e.g., the shovel may be linked to the boom by means of parallel links. Such a parallel kinematic is, however, very complex and correspondingly costly.

In contrast, the invention is based on the object of furnishing a hydraulic control system for a mobile equipment, in particular a wheel loader or a backhoe loader, wherein such "self-levelling" is achieved at minimum complexity in terms of apparatus.

This object is achieved through a hydraulic control system for a mobile equipment, in particular for a backhoe loader or a wheel loader, having a shovel retained on a boom which is adapted to be pivoted by means of a boom cylinder, which may be pivoted by means of a shovel cylinder adapted to be controlled by means of a shovel control unit, wherein the shovel position may be fed back via a transmitting member to an orientation control device whereby the shovel cylinder may be controlled, and wherein the orientation control device comprises an actuation head in operative connection with the transmitting member, the position change of said actuation head during a pivoting movement of the shovel being convertable via a control device into a control signal for keeping the shovel in a target angular position, characterized in that a basic position of the actuation head is variable, and in that the transmitting member is connected with the actuation head such that both downward pivoting of the shovel and upward Pivoting of the shovel from its target angular position results in a positional change of the actuation head, so that depending on this positional change a control signal for returning the shovel into its target angular position at the shovel cylinder may be emitted, and also the actuation head may be reset in the direction of its pre-set basic position.

In accordance with the invention, the shovel linked to a boom is maintained in a predetermined position relative to the ground or to the axles of the backhoe/wheel loader by means of an orientation control device. The orientation control device comprises a transmitting member which transmits the pivoting movement of the shovel to an actuation head, the basic position of which is adjustable. This basic position of the actuation head of the orientation control device corresponds to a position of the shovel relative to the equipment which is to be kept constant. As long as the shovel maintains its pre-adjusted angular position during the pivoting movement of the boom, the actuation head remains in its adjusted basic position. In the event of a change of the angular position, the actuation head is shifted, and in dependence on this shift a control signal is generated which is conducted to a shovel control for adjusting a shovel cylinder in such a way that the shovel resumes its pre-adjusted angular position, and the actuation head is returned correspondingly.

In other words, in accordance with the invention a target angular position of the shovel is adjusted with the aid of the adjustable actuation head, and an intervention in the control of the shovel is carried out if the latter moves out of the pre-set angular position. Such a control system allows to set practically any desired angular position as a target value and keep it constant during the pivoting movement of the boom, wherein the complexity in technological terms is extremely low.

In the subject matter of WO 02/081828 A1 discussed at the outset, neither the target angular position of the shovel may be adjusted nor could the shovel be adjusted downwardly (tilted) during the pivoting movement of the boom, so that a target position relying on this movement can not be reached by the known solution.

In a particularly preferred embodiment, the actuation head of the orientation control device has the form of an actuation lever of a pilot control device, the electric or hydraulic control signals of which are supplied to the shovel control unit.

This pilot control device is preferably executed with two hydraulic pilot control elements, the control ports of which are connected with the control ports of the shovel control unit via signal lines.

This shovel control unit may in turn be executed with a hydraulic shovel pilot control device, the control ports of which are connected via control lines with control chambers of a proportional valve for controlling the shovel cylinder. The control line of the shovel pilot control device and the signal lines leading to the pilot control device of the orientation control device are interconnected via shuttle valves, so that in the control chambers of the proportional valves the respective higher control pressure is present which is either predetermined by the pilot control device or by the shovel pilot control device in order to adjust an angular position of the shovel.

In a variant of the invention, feeding back of the movement of the transmitting member to the control lever takes place through the intermediary of a spring assembly which is acted upon in a direction opposite to the spring assembly by a tensile spring assembly, with the latter in turn acting on an actuation lever, so that it is possible to adjust a target position of the control lever by adjusting this actuation levers.

In an alternative variant it is possible to use, instead of the springs attacking on either side of the control lever, a suitable lever mechanism which on the one hand enables the adjustment of a target value and on the other hand transforms a relative movement of the transmitting member into a pivoting movement of the actuation lever.

Manufacture of the orientation control device is particularly simple if the transmitting member has the form of a thrust rod which engages in parallel with the boom at the shovel, wherein the end portion of the thrust rod removed from the shovel is mounted on a frame of the equipment through the intermediary of a movable bearing and is connected with the actuation lever via the afore-mentioned springs or the lever mechanism or means having a similar action.

The orientation control device may very easily be deactivated if a pressure port of the control device is adapted to be connected to a control oil pump or a tank via a switching valve. Upon switching to tank pressure it is not possible to output a signal via the pilot control device to supersede the control pressure output by the shovel pilot control device—self-levelling does not take place.

Further advantageous developments of the invention are subject matter of further subclaims.

In the following, preferred embodiments of the invention are explained by referring to schematic drawings, wherein.

Figure 1:
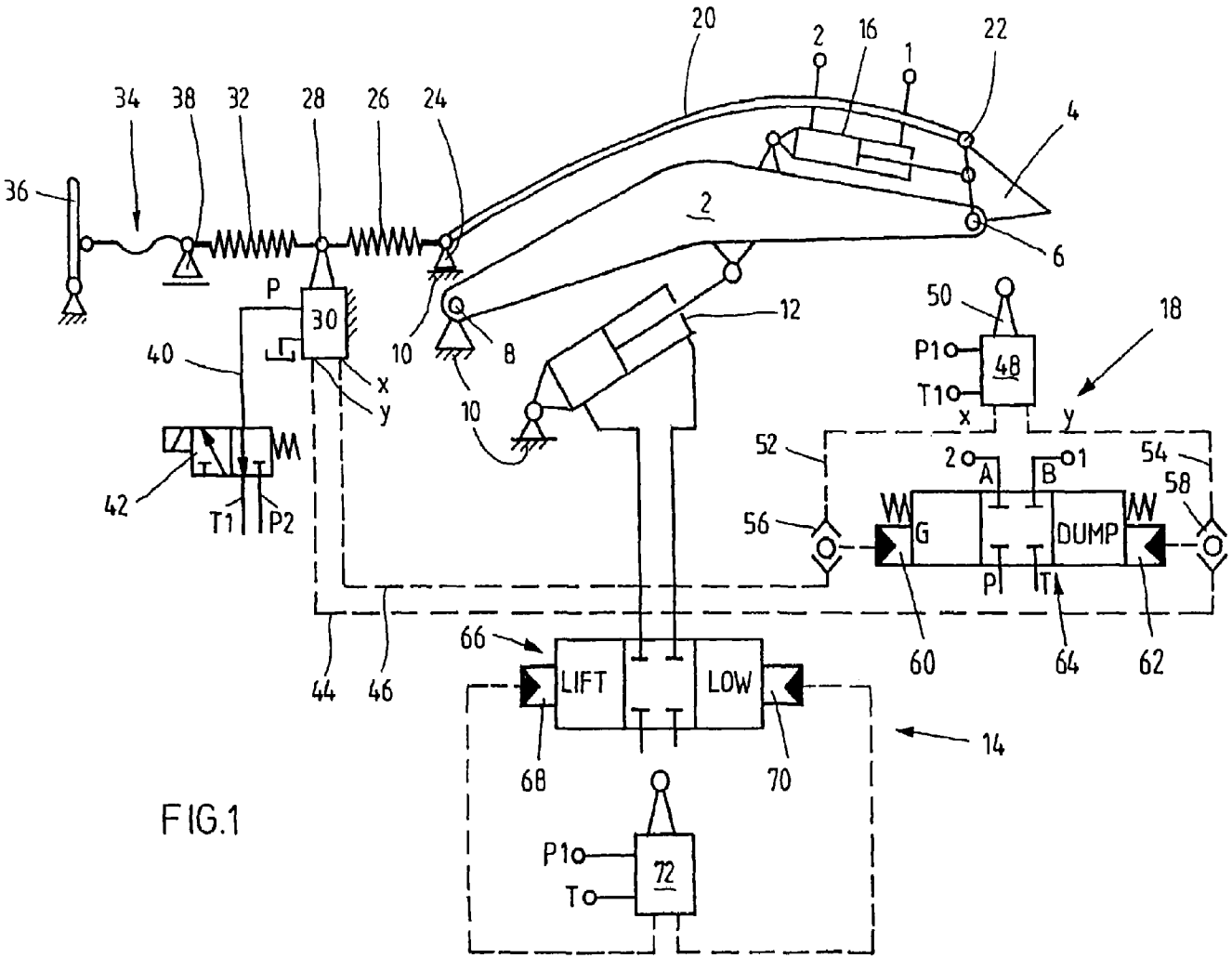
FIG. 1 is a diagrammatic view of a control system in accordance with the invention for maintaining a pre-set angular position of a shovel constant.

FIG. 1 shows a diagrammatic view of a control system of a mobile equipment, e.g., of a wheel loader or of a backhoe loader. The latter comprises a boom 2, to the free end portion of which a shovel 4 is linked by means of a pivoted articulation 6. The other end portion of the boom 2 is linked to a frame 10 of the backhoe loader through the intermediary of a linking mechanism 8.

The pivoting movement of the boom 2 is executed by means of a double-acting boom cylinder 12 which may be supplied with pressure medium via a cylinder control unit 14. The boom cylinder 12 is articulatedly supported at the frame 10 and engages with its piston rod on the boom 2. The pivoting movement of the shovel 4 relative to the boom 2 is executed with the aid of a shovel cylinder 16, the housing of which is linked to the boom 2, and the piston rod of which engages with the shovel 4. This shovel cylinder 16 too, is realized as a double-action cylinder and is supplied with pressure medium via a shovel control unit 18.

In accordance with FIG. 1, a thrust rod 20 is moreover mounted at the shovel 4 by means of a thrust rod articulation 22, said thrust rod extending in the represented angular position in parallel with the boom 2. The end portion of the thrust rod 20 which is removed from the shovel 4 is supported on a frame-side movable bearing 24 adapted to move relative to the boom 2 in the event of a change of the angular position of the shovel 4. At a constant angular position of the shovel 4 relative to the equipment, the boom and the thrust rod 20 as well as the pivoted articulation 6 and the thrust rod bearing 22 on the one hand and the linking mechanism 8 and the movable bearing 24 on the other hand form a parallelogram that changes its geometry during the pivoting movement of the boom 2, however essentially remains a parallelogram (as long as the angular position of the shovel 4 relative to the axles of the backhoe loader remains unchanged).

In the embodiment represented in FIG. 1, the thrust rod 20 which is supported at the movable bearing 24 is connected via a spring or spring assembly 26 with an actuation lever 28 of a hydraulic pilot control device 30. The control lever 28 is acted upon in a direction opposite to the spring assembly 26 by a tensile spring assembly 32 having its one end portion removed from the control lever 28 attached to an actuation means 34 which, in the represented embodiment, consists of an actuation lever 36 and a sliding joint 38 connected with the latter either directly or via signal lines, the position of which is variable, and which engages with the tensile spring assembly 32.

By pivoting the actuation levers 36, the sliding joint 38 may be moved indirectly or directly to thus adjust the bias of the tensile spring assembly 32, so that the spring assembly 26 is adjusted, and the control lever 28 may be returned into a desired basic position in accordance with the bias.

The hydraulic pilot control device 30 is in a known manner executed with pressure reducing valves which are adapted to be shifted into a regulating position in dependence on the pivoting movement of the actuation lever 28. By means of these pressure reducing valves the pressure at a control oil port P of the pilot control device 30 may be reduced to a desired control pressure which is then present at control ports X, Y of the pilot control device 30. Inside a control oil line 40 connected to the control oil port P an electrically actuated switching valve 42 is arranged which in its spring-biased basic position connects the control oil line 40 with a tank T, and upon energization of a switching solenoid connects the control oil line 40 with a pump line that is connected to a control oil pump. In other words, in the spring-biased basic position the pilot control device 30 does not have an effect as tank pressure prevails at its control oil port P. In the switching position, the control oil port P is connected with the control oil pump, so that control signals may be generated via the pilot control device 30.

The two control ports X, Y are connected via signal lines 44, 46 with the shovel control unit 18. The latter comprises a shovel pilot control device 48, and by means of the actuation lever 50 of the latter the control oil pressure furnished by the mentioned control oil pump may be reduced to a desired control pressure. This shovel pilot control device 48 is provided, for example, with four pressure reducing valves, whereby, e.g., the angular position of the shovel relative to the boom 2 and the angular velocity of the pivoting movement may be adjusted.

The two control ports X, Y of the shovel pilot control device 48 are each connected via control lines 52, 54 with the inlet of a shuttle valve 56 or 58, respectively, to the other inlet of which the signal line 46 or 44, respectively, is connected. The outlets of the shuttle valves 56, 58 are each connected with control chambers 60, 62 of a shovel proportional valve 64. By means of the latter, the pressure medium flow velocity and pressure medium direction of flow between the pressure chambers of the shovel cylinder 16 and a variable displacement pump or a tank T of the central unit are controlled in a known manner. In its center position, a pressure port P connected with the variable displacement pump and a tank port T connected with the tank are blocked relative to two work ports A, B leading to the pressure chambers of the shovel cylinder 16. In the right-hand (FIG. 1) positions (valve spool to the left, "DUMP") of the shovel proportional valve 64, the shovel 4 is pivoted downwards from the represented angular position in order to dump material; in the left-hand positions (CROWD), the shovel 4 is pivoted upwards from the represented angular position, e.g., in order to pick up material and hold it in the shovel.

The boom control unit 14 has a similar construction as the shovel control unit 18. Pressure medium supply of the boom cylinder 12 takes place via a cylinder proportional valve 66, the control chambers 68, 70 of which may be subjected to a control pressure through the intermediary of a cylinder pilot control device 72 in order to retract the cylinder in the right-hand (view of FIG. 1) positions (LOW), so that the boom 2 is lowered, and to extend the cylinder in the left-hand positions (LIFT) for raising the boom.

It shall now be assumed that the boom 2 was pivoted downwards from the represented raised position, and the shovel 4 rests on the ground in the represented angular position. The shovel 4 is filled with material which should not fall out from it when the boom 2 is raised subsequently. It is therefore desired to keep the shovel 4 in the represented angular position or even pivoted upwards more strongly, relative to the ground or to the axles of the vehicle. The control lever 28 is in its represented basic position that corresponds to the mentioned angular position of the shovel 4. In this basic position the control lever 28 is clamped between the tensile spring assembly 32 and the spring assembly 26, with the actuation lever 36 also in its basic position. In order to raise the boom 2, the boom proportional valve 66 is shifted through the intermediary of the boom pilot control device 72 into one of its left-hand positions (LIFT), so that the boom cylinder 12 extends with a corresponding velocity and pivots the boom 2 upwardly about the linking mechanism 8 that is fixed to the frame. If the angular position of the shovel 4 remains constant relative to the ground during this pivoting movement, the position of the control lever 28 also remains unchanged, and no control signal is output by the pilot control device 30. In a change of the angular position of the shovel 4, e.g., pivoting about the pivoted articulation 6 to the left (in a counter-clockwise direction), the thrust rod 20 is moved correspondingly and the movable bearing 24 is shifted to the left, so that the tension of the spring assembly 26 is reduced correspondingly. The position of the sliding joint 38 remains unchanged, and the actuation lever 28 is moved to the left until an equilibrium between the tensile spring assembly 32 and the spring assembly 26 is established. In accordance with this pivoting movement of the control lever 28 a hydraulic control signal is generated by the pilot control device 30, so that the control chambers 60, 62 of the shovel proportional valve 64 are subjected to a corresponding control pressure difference. Owing to this control pressure difference, the shovel proportional valve 64 is taken into one of its right-hand positions (DUMP), so that the shovel 4 is pivoted in a clockwise direction until the basic position pre-selected at the actuation lever 28 is again established. The control pressure in the signal lines 44, 46 is selected such as to be higher than a control pressure in control lines 52, 54, so that this self-levelling is performed even if a control pressure which prevails at the associated inlets of the shuttle valves 56 and 58, respectively, is created through the shovel pilot control device 48 in the control lines 52, 54.

The afore-described self-levelling is, however, only possible when the switching valve 42 is taken by means of the switching solenoid into its switching position in which a control oil pressure is present at pressure port P of the pilot control device 30. If the switching valve 42 is de-energized, the shovel position 4 may be adjusted manually through the intermediary of the pilot control device 48.

By operating the actuation lever 36 it is possible to pivot the control lever 28 from the represented basic position in order to alter the pre-adjusted angular position of the shovel 4 while self-levelling is activated. This new angular position may be adjusted independently of the adjustment of the shovel pilot control device 48, for its control pressures are overridden. During raising or lowering of the boom 2 this altered angular position of the shovel 4 is then maintained constant through feeding back a movement of the thrust rod 20 to the pilot control device 30 and the resulting application of a control pressure difference on the shovel proportional valve 64. The afore-described regulation of the angular position may be realized at minimum complexity, wherein it is practically possible to adjust any angular position of the shovel 4 that is permitted by the loading geometry.

Instead of the hydraulic pilot control devices 30 it is in principle also possible to use an electric pilot control, wherein the electric signals for controlling the correspondingly executed shovel proportional valve 64.

Instead of the spring assembly for feeding back a change of the angular position of the shovel 4 to the pilot control device 30 it is, of course, also possible to use other constructions.

Figure 2:
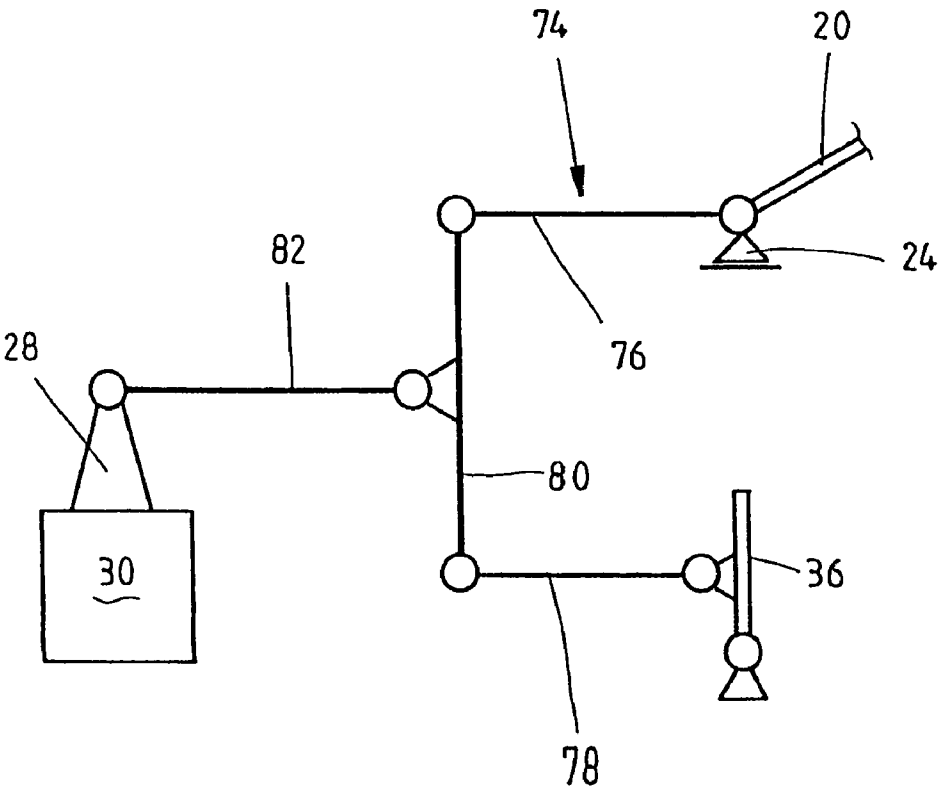
FIG. 2 shows a variant of an orientation control device of the control system of FIG. 2.

FIG. 2 shows an embodiment wherein the movable bearing 24 (sliding joint) of the thrust rod 20 is connected via a lever arrangement 74 with the control lever 28 in order to feed back a change of the angular position of the shovel 4 to the pilot control device 30. The lever arrangement represented in FIG. 2 has two slide levers 76, 78 coupled by an end portion at the movable bearing 24 and at the actuation lever 36, respectively, while the two other end portions are articulatedly connected to each other by means of a transverse lever 80.

Approximately in the center range of the transverse lever 80, a connecting arm 82 is coupled which is articulatedly connected with the control lever 28. In the case of a constant adjustment of the actuation lever 36 and a movement of the thrust rod 20 along the trajectory of the movable bearing 24, the slide lever 76 is moved accordingly, so that the transverse lever 80 is tilted from its represented vertical position, and the actuation lever 28 is moved accordingly. The actual position must be adjusted by pivoting the actuation lever 36 and correspondingly moving the lower slide lever 78, which in turn results in a pivoting movement of the transverse lever 80 and in an actuation of the control lever 28 into its new basic position.

Figure 3:
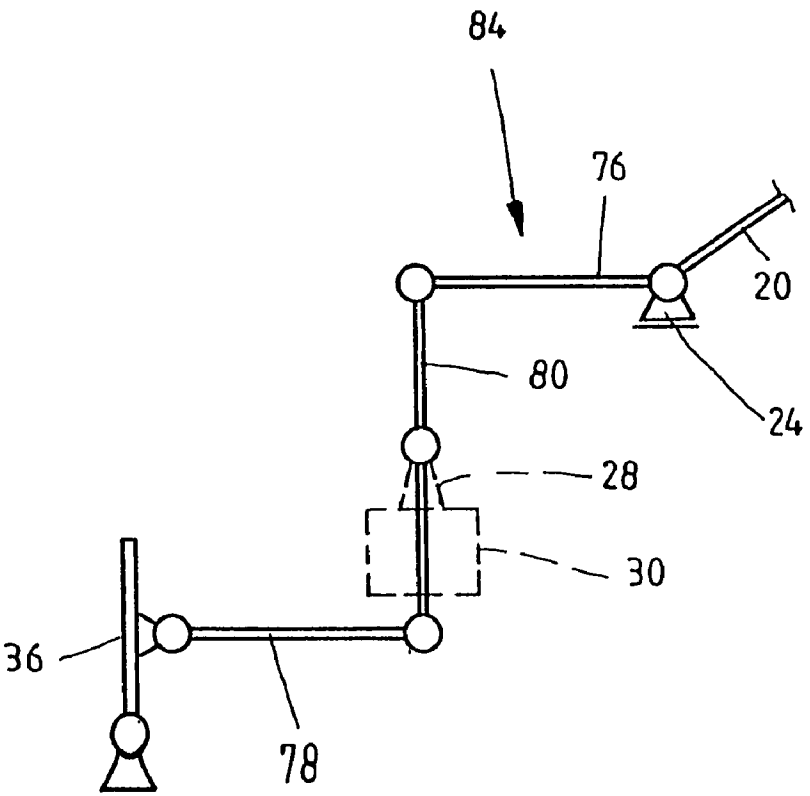
FIG. 3 is another embodiment of an orientation control device.

In the embodiment represented in FIG. 3, instead of the U-shaped lever arrangement 74 an approximately z-shaped lever arrangement 84 is used where the slide levers 76, 78 attack in opposite directions at the transverse lever 80. The control lever 28 is linked to the transverse lever 80. During a displacement of the thrust rod 20, the slide lever 76 is driven accordingly, and the transverse lever 80 is pivoted, and the control lever 28 is actuated accordingly. The adjustment of the target pivotal position is effected by means of the actuation lever 36 whereby the slide lever 78 may be displaced, and accordingly the transverse lever 80 may be pivoted.

It is essential in the kinematic of these means that a change of the pivotal position of the shovel position 4 may be transposed into an adjustment of the pilot control device 30 wherein the latter outputs a control signal for controlling the shovel proportional valve 64 so as to move the latter into a regulating position in which the shovel 4 may again be returned into the pre-adjusted angular position.

What is disclosed is a hydraulic control system for a mobile equipment, in particular for a wheel or backhoe loader, wherein a shovel is linked to a boom. The angular position of the shovel may be kept constant through the intermediary of an orientation control device during a pivoting movement of the boom relative to the axles of the equipment. In accordance with the invention, the orientation control device is realized such that in the event of a change of a pre-set angular position, a control signal is generated through a pilot control device, whereby a shovel control unit may be controlled in such a manner that the shovel is again returned into its predetermined angular position.

LIST OF REFERENCE SYMBOLS

2 boom
4 shovel articulation
6 pivoted articulation
8 linking mechanism
10 frame
12 boom cylinder
14 boom control unit
16 shovel cylinder
18 shovel control unit
20 thrust rod
22 thrust rod bearing
24 movable bearing
26 spring assembly
28 control lever
30 pilot control device
32 tensile spring assembly
34 actuation means
36 actuation lever
38 sliding joint
40 control oil line
42 switching valve
44 signal line
46 signal line
48 shovel pilot control device
50 control lever
52 control line
54 control line
56 shuttle valve
58 shuttle valve
60 control chamber
62 control chamber
64 shovel proportional valve
66 boom proportional valve
68 control chamber
70 control chamber
72 boom pilot control device
74 lever arrangement
76 slide lever
78 slide lever
80 transverse lever
82 connecting arm

The invention claimed is:

1. A hydraulic control system for a mobile machine having a shovel retained on a boom that is pivoted by a boom cylinder, the shovel being pivoted by a shovel cylinder, and a transmitting member being operably connected to the shovel, the hydraulic control system comprising:

a shovel control unit configured to control the shovel cylinder;

a boom control unit configured to control the boom cylinder; and an orientation control device configured to receive a position of the shovel from the transmitting member and transmit hydraulic or electric signal indicative of the shovel position to the shovel control unit, the orientation control device comprising:

a control lever having a variable basic position and being in operative connection with the transmitting member such that both a downward pivoting of the shovel and an upward pivoting of the shovel from a target angular position results in a positional change of the control lever;

a spring assembly that connects the control lever with the transmitting member and a tensile spring assembly that connects the control lever with an actuation lever whereby a target position of the control lever may be adjusted by the actuation lever and the pivotal change of the shovel can be transferred to the control lever by the transmitting member; and a pilot control device configured to convert the positional change of the control lever during the pivotal change of the shovel into an electric or hydraulic control signal for at least one of keeping the shovel in the target angular position, returning the shovel to the target angular position, and resetting the control lever in a direction of a pre-set basic position of the control lever.

2. The control system in accordance with claim 1, wherein the pilot control device comprises two control ports that are connected via signal lines to control ports of the shovel control unit.

3. The control system in accordance with claim 1, wherein the shovel control unit comprises a shovel pilot control device with control ports that are connected via control lines to shuttle valves and signal lines connect the shuttle valves to control chambers of a shovel proportional valve such that a higher one of control pressures in the control chambers prevails.

4. The control system in accordance with claim 1, wherein an end portion of the transmitting member that is linked to the spring assembly is mounted on a frame of a mobile machine by a movable bearing.

5. The control system in accordance with claim 1, wherein a pressure port of the pilot control device is connected with a control oil pump or a tank via a switching valve.

6. A hydraulic control system for a mobile machine having a shovel retained on a boom that is pivoted by a boom cylinder, the shovel being pivoted by a shovel cylinder, and a transmitting member being operably connected to the shovel, the hydraulic control system comprising:

a shovel control unit configured to control the shovel cylinder;

a boom control unit configured to control the boom cylinder; and an orientation control device configured to receive a position of the shovel from the transmitting member and transmit a hydraulic or electric signal indicative of the shovel position to the shovel control unit, the orientation control device comprising:

a control lever having a variable basic position and being in operative connection with the transmitting member such that both a downward pivoting of the shovel and an upward pivoting of the shovel from a target angular position results in a positional change of the control lever;

a lever mechanism connects the control lever with the transmitting member and an actuation lever for adjusting the target position of the control lever, the lever mechanism being realized such that a target pivotal position of the control lever is adjusted through the intermediary of the actuation lever, and the control lever is adjusted when the shovel has been moved from the target angular position ; and a pilot control device configured to convert the positional change of the control lever during the pivoting movement of the shovel into an electric or hydraulic control signal for at least one of keeping the shovel in the target angular position, returning the shovel to the target angular position, and resetting the control lever in a direction of a pre-set basic position of the control lever.

7. The control system in accordance with claim 6, wherein the pilot control device comprises two control ports that are connected via lines to control ports of the shovel control unit.

8. The control system in accordance with claim 6, wherein the shovel control unit comprises a shovel pilot control device with control ports that are connected via control lines to shuttle valves and signal lines connect the shuttle valves to control chambers of a shovel proportional valve such that a higher one of control pressured in the control chambers prevails.

9. The control system in accordance with claim 6, wherein an end portion of the transmitting member that is linked to the spring assembly is mounted on a frame of a mobile machine by a movable bearing.

10. The control system in accordance with claim 6, wherein a pressure port of the pilot control device is connected with a control oil pump or a tank via a switching valve.

* * * * *